US011761725B1

(12) United States Patent
Sanders et al.

(10) Patent No.: US 11,761,725 B1
(45) Date of Patent: Sep. 19, 2023

(54) FIREARM SUPPRESSOR MOUNT WITH FOULING REAMER

(71) Applicant: OSS Suppressors Inc., Millcreek, UT (US)

(72) Inventors: David Sanders, Millcreek, UT (US); A. Kai Bradshaw, Millcreek, UT (US)

(73) Assignee: OSS Suppressors LLC, Millcreek, UT (US)

( * ) Notice: Subject to any disclaimer, the term of this patent is extended or adjusted under 35 U.S.C. 154(b) by 0 days.

(21) Appl. No.: 18/080,159

(22) Filed: Dec. 13, 2022

(51) Int. Cl.
*F41A 21/32* (2006.01)
*F41A 29/00* (2006.01)
*F41A 21/36* (2006.01)

(52) U.S. Cl.
CPC ..... *F41A 21/325* (2013.01); *F41A 21/36* (2013.01); *F41A 29/00* (2013.01)

(58) Field of Classification Search
CPC ..... F41A 21/325; F41A 21/36; F41A 29/00; F41A 21/30–38; F41A 29/02
USPC ..... 89/14.2–14.4; 181/223
See application file for complete search history.

(56) References Cited

U.S. PATENT DOCUMENTS 885,166 A * 4/1908 Mason ..... F41A 5/26 89/193
4,123,963 A * 11/1978 Junker ..... F41A 15/20 102/431
7,461,581 B2 12/2008 Leitner-Wise
7,938,055 B2 5/2011 Hochstrate et al.
8,910,746 B1 * 12/2014 McKenzie ..... F41A 21/30 181/223
9,121,656 B1 * 9/2015 McKenzie ..... F41A 21/30
9,261,319 B1 * 2/2016 Palu ..... F41A 21/34
10,330,420 B2 * 6/2019 Kunsky ..... F41A 21/30
10,451,374 B2 10/2019 Palu et al.
10,760,866 B2 * 9/2020 Facchini ..... F41A 21/30
(Continued)

FOREIGN PATENT DOCUMENTS

EP 3 699 541 A1 2/2019
WO WO 2018/069884 A1 4/2018

OTHER PUBLICATIONS

Hansohn, "Q Plan B," Hansonbrothers.com, sales@hansohnbrothers.com, accessed Aug. 9, 2022.
(Continued)

*Primary Examiner* — Joshua E Freeman
*Assistant Examiner* — Benjamin S Gomberg
(74) *Attorney, Agent, or Firm* — THORPE NORTH AND WESTERN LLP; Erik S. Ericksen

(57) ABSTRACT

A suppressor mount device can include a first end having a barrel coupling feature adapted to couple the suppressor mount device to the barrel of a firearm. The device can further include a second end oriented opposite the first end along a bore axis and a suppressor coupling feature adapted to receive and retain a firearm suppressor. The device can further include a bore forming a void along the bore axis within the suppressor mount device, the bore adapted to allow passage of a projectile along the bore axis from the first end to the second end. The device can further include a reaming feature formed on an outer surface of the second end adapted to engage an inner surface of the firearm suppressor. The reaming feature can include a channel which is at least partially oriented non-parallel and non-perpendicular to the bore axis.

20 Claims, 12 Drawing Sheets

(56) References Cited

U.S. PATENT DOCUMENTS

| | | | | |
|---|---|---|---|---|
| 11,092,400 | B2 | 8/2021 | Moller et al. | |
| 11,118,856 | B2 * | 9/2021 | Dunham | F41A 21/30 |
| 2020/0173750 | A1 * | 6/2020 | Riley | F41A 21/30 |

OTHER PUBLICATIONS

Soldier, "Maxim Defense DRF-22 Rimfire Suppressor," Soldier Systems, https://soldiersystems.net/2022/05/17/the-sterling-promise-foundation-fundraising-raffle/, accessed Aug. 9, 2022.

* cited by examiner

FIREARM SUPPRESSOR MOUNT WITH FOULING REAMER

BACKGROUND

Firearm suppressors and suppressor technology have been present in the firearm industry for decades to provide a way to reduce acoustic noise caused by firearm blasts. Along with firearm suppressors, multiple methods and devices have been developed for mounting suppressors to a firearm. Suppressor mounts, suppressor mount barrels, and/or suppressor mount adapters have been designed and developed with different types of interfaces between the mount and the suppressor to facilitate quick attachment and detachment of suppressors from the firearms. Suppressor mounts typically include an interface between the mount (e.g., barrel or adapter) and the suppressor in which an outer circumference of the mount interfaces with an inner diameter of the suppressor.

Gaps between the outer diameter of the mount and the inner diameter of the suppressor can have very small dimensions. For example, the inner diameter/outer diameter tolerance (e.g., gap between the suppressor mount and the suppressor) in many standard 3-lug interfaces can be about one-thousandth of an inch. As a natural byproduct of a firearm discharging a projectile, carbon, lead, gunpowder, and/or copper fouling can build up within the gap at the interface between the suppressor and the suppressor mount. As the fouling builds up at the interface between the suppressor and the mount, the fouling can cause binding between the suppressor and the mount at the interface during attachment and/or detachment of the suppressor from the suppressor mount. Such fouling buildup in gaps between the suppressor and the mount can lead to binding and/or difficulties in removing or attaching the suppressor. Therefore, new ways to reduce the amount of fouling that collects at a mounting interface between a suppressor and a mount, and/or new ways to clean accumulated fouling from the mounting interface between the suppressor and the mount continue to be researched and tested to improve maintenance and performance of suppressor mounts and can facilitate quicker and more reliable attachment and removal of suppressors from firearms.

SUMMARY

The technology described herein provides a suppressor mount that facilitates fouling cleaning and removal from a mounting interface at which a firearm suppressor is attached to a suppressor mount, suppressor mount barrel, and/or suppressor mount adapter. Reduction and consistent cleaning of copper and carbon fouling at mounting interfaces between a suppressor and a suppressor mount can reduce chances of binding between the suppressor and the mount, which helps to facilitate quick, reliable removal and installation of suppressors to firearms. Additionally, consistent cutting and cleaning of fouling from a mounting interface during attachment and detachment of a suppressor from a suppressor mount can reduce the amount of maintenance operations that must be performed by a user, thereby improving convenience and usability for a user of a firearm including a suppressor and suppressor mount.

To achieve the above purposes, a suppressor mount adapter is described herein that includes a reaming feature for clearing fouling from a suppressor during attachment and/or detachment of the suppressor from the suppressor mount adapter.

In one example, a suppressor mount device according to the present disclosure can include a first end having a barrel coupling feature adapted to couple the suppressor mount device to the barrel of a firearm. The suppressor mount device can further include a second end oriented opposite the first end along a bore axis and comprising a suppressor coupling feature adapted to receive and retain a firearm suppressor. The suppressor mount device can further include a bore forming a void along the bore axis within the suppressor mount device, with the bore being adapted to allow passage of a projectile along the bore axis from the first end to the second end. The suppressor mount device can further include a reaming feature formed on an outer surface of the second end adapted to engage an inner surface of the firearm suppressor. The reaming feature can include a channel which is at least partially oriented non-parallel and non-perpendicular to the bore axis of the firearm.

In some examples, the suppressor coupling feature can include one or more lugs that protrude outward from an outer circumferential surface of the suppressor mount device and are adapted to receive and retain the firearm suppressor.

In some examples, the suppressor coupling feature can include three lugs that protrude outward from the outer circumferential surface of the suppressor mount device and are adapted to receive and retain the firearm suppressor.

In some examples, the three lugs can be radially spaced at equal distances from each other around the outer circumferential surface.

In some examples, the suppressor coupling feature can include a threaded feature formed on an outer circumferential surface of the suppressor mount device that corresponds to a complementary threaded feature formed in the firearm suppressor and is adapted to receive and retain the firearm suppressor.

In some examples, the threaded feature can be threaded in a direction such that the direction of rifling rotation imparted on the projectile from the barrel of the firearm tightens the firearm suppressor onto the suppressor mount device.

In some examples, the suppressor coupling feature can include a notch adapted to engage with a protrusion of the firearm suppressor.

In some examples, the suppressor coupling feature can include a protrusion adapted to engage with a notch of the firearm suppressor.

In some examples, the barrel coupling feature can include a threaded barrel coupling feature formed on an outer surface or an inner surface of the first end adapted to mate with a corresponding threaded barrel coupling feature formed on the barrel of the firearm.

In some examples, the threaded barrel coupling feature can be threaded in a direction on the first end such that the direction of rifling rotation imparted on the projectile from the barrel of the firearm tightens the suppressor mount on to the barrel of the firearm.

In some examples, the channel can be formed in an at least partially helical path around the outer surface of the second end.

In some examples, one or more edges of the channel can include a sharpened edge to further facilitate removal of fouling from the inner surface of the firearm suppressor during attachment and detachment of the firearm suppressor from the suppressor mount device.

In some examples, the sharpened edge has an angle relative to the outer surface of the second end of 90° or less.

In some examples, the reaming feature can include a plurality of channels, each formed in an at least partially helical path around the outer surface of the second end.

In some examples, one or more edges of one or more of the plurality of channels can include a sharpened edge to further facilitate removal of fouling from the inner surface of the firearm suppressor during attachment and detachment of the firearm suppressor from the suppressor mount device.

In some examples, the suppressor mount device can be a muzzle brake.

In an additional example, the suppressor mount device according to the present disclosure can be a 3-lug adapter. The 3-lug adapter can include a first end having a barrel coupling feature adapted to couple the 3-lug adapter to the barrel of a firearm. The 3-lug adapter can further include a second end oriented opposite the first end along a bore axis and comprising three lugs that are radially spaced to protrude outward from an outer circumferential surface of the 3-lug adapter and are adapted to receive and retain a firearm suppressor. The 3-lug adapter can further include a bore forming a void along the bore axis within the 3-lug adapter, with the bore being adapted to allow passage of a projectile along the bore axis from the first end to the second end. The 3-lug adapter can further include a reaming feature formed on the outer circumferential surface of the second end and adapted to engage an inner surface of the firearm suppressor to clean fouling from the inner surface of the firearm suppressor during attachment and detachment of the firearm suppressor from the 3-lug adapter. The reaming feature can include a plurality of channels each formed in an at least partially helical path about the outer circumferential surface of the second end.

In some examples, the barrel coupling feature can include a threaded feature formed on an outer surface or an inner surface of the first end adapted to mate with a corresponding threaded feature formed on the barrel of the firearm. The threaded feature can be threaded in a direction on the first end such that the direction of rifling rotation imparted on the projectile from the barrel of the firearm tightens the 3-lug adapter on to the barrel of the firearm.

In some examples, one or more edges of one or more of the plurality of channels can include a sharpened edge to further facilitate removal of fouling from the inner surface of the firearm suppressor during attachment and detachment of the firearm suppressor from the 3-lug adapter.

In some examples, the 3-lug adapter can be further adapted as a muzzle brake.

There has thus been outlined, rather broadly, the more important features of the invention so that the detailed description thereof that follows may be better understood, and so that the present contribution to the art may be better appreciated. This summary includes broad inventive principles, as well as optional alternatives which are not required for operation of the invention as contemplated. Other features of the present invention will become clearer from the following detailed description of the invention, taken with the accompanying drawings and claims, or may be learned by the practice of the invention.

Figure 1:
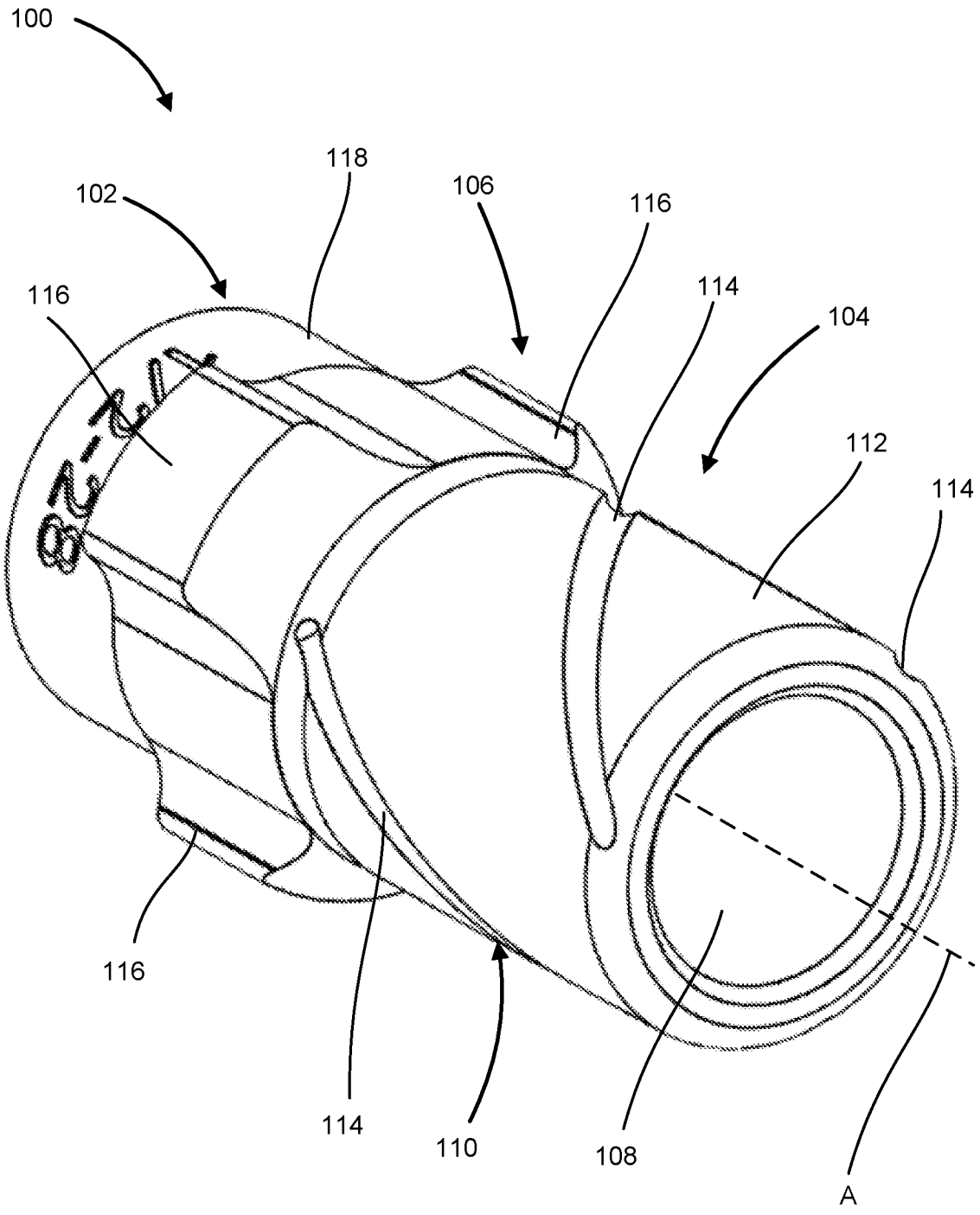
FIG. 1 is an isometric view of a suppressor mount adapter or device in accordance with examples of the present technology.

These figures are provided for convenience in describing the following aspects. In particular, variation may be had in dimensions, materials, configurations and proportions from those illustrated and not depart from the scope of the invention.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "a tube" includes reference to one or more of such members, and reference to "directing" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of about 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Suppressor Mount Adapter

Suppressor mount adapters are commonly used on a barrel of a firearm to configure the barrel to receive a firearm suppressor that is used to quiet discharge sounds from the firearm. An exemplary suppressor mount device 100 for adapting a barrel of a firearm to receive a firearm suppressor is illustrated in FIGS. 1-7. The suppressor mount device 100 provides new and advantageous features over the current state of the art to improve functionality and maintenance of firearm suppressors. The suppressor mount device 100, as shown in FIG. 1, can include a first end 102 having a barrel coupling feature adapted to couple the suppressor mount device to the barrel of a firearm. The barrel coupling feature will be described in further detail below. The suppressor mount device 100 can further include a second end 104 oriented opposite the first end 102 along a bore axis A and comprising a suppressor coupling feature 106 adapted to receive and retain a firearm suppressor. The suppressor mount device 100 can further include a bore 108 forming a void along the bore axis A within the suppressor mount device 100. The bore 108 can be adapted to allow passage of a projectile along the bore axis A from the first end 102 to the second end 104. The suppressor mount device 100 can further include a reaming feature 110 formed on an outer surface 112 of the second end 104. The reaming feature 110 can be adapted to engage an inner surface of the firearm suppressor. The reaming feature 110 can include one or more channels 114 formed in the outer surface 112 of the second end 104. The one or more channels 114 can be at least partially oriented non-parallel and non-perpendicular to the bore axis A of the suppressor mount device 100. For example, as shown in FIG. 1, each of the channels 114 of the reaming feature 110 can be formed in an at least partially helical path around the outer surface 112 of the second end 104. In this example, the reaming features are completely helical having a common pitch throughout. However, in some cases, the reaming feature can vary in pitch along a length of the reaming feature.

Figure 2:
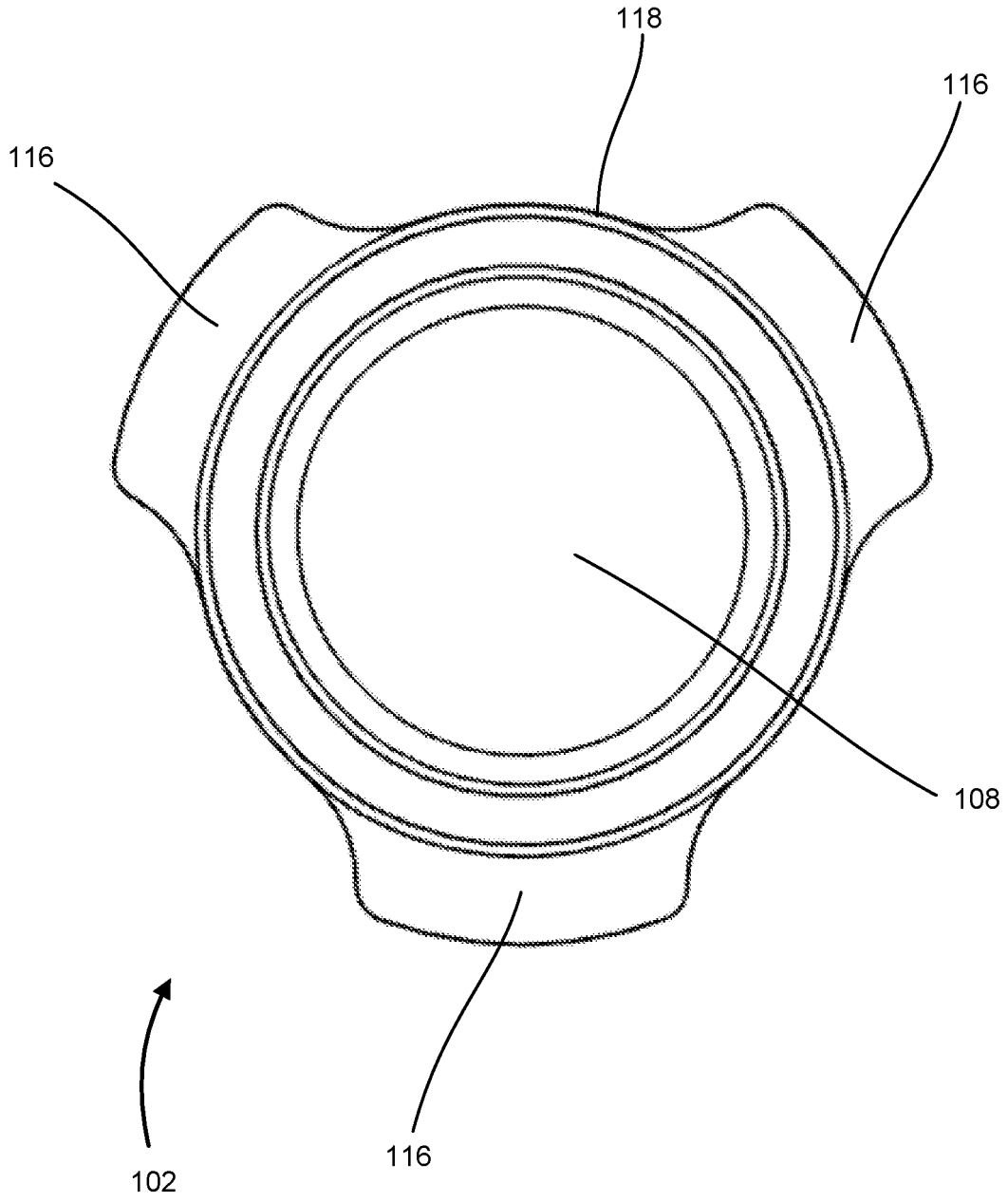
FIG. 2 is an end view of a first end of the suppressor mount adapter or device of FIG. 1.
Figure 3:
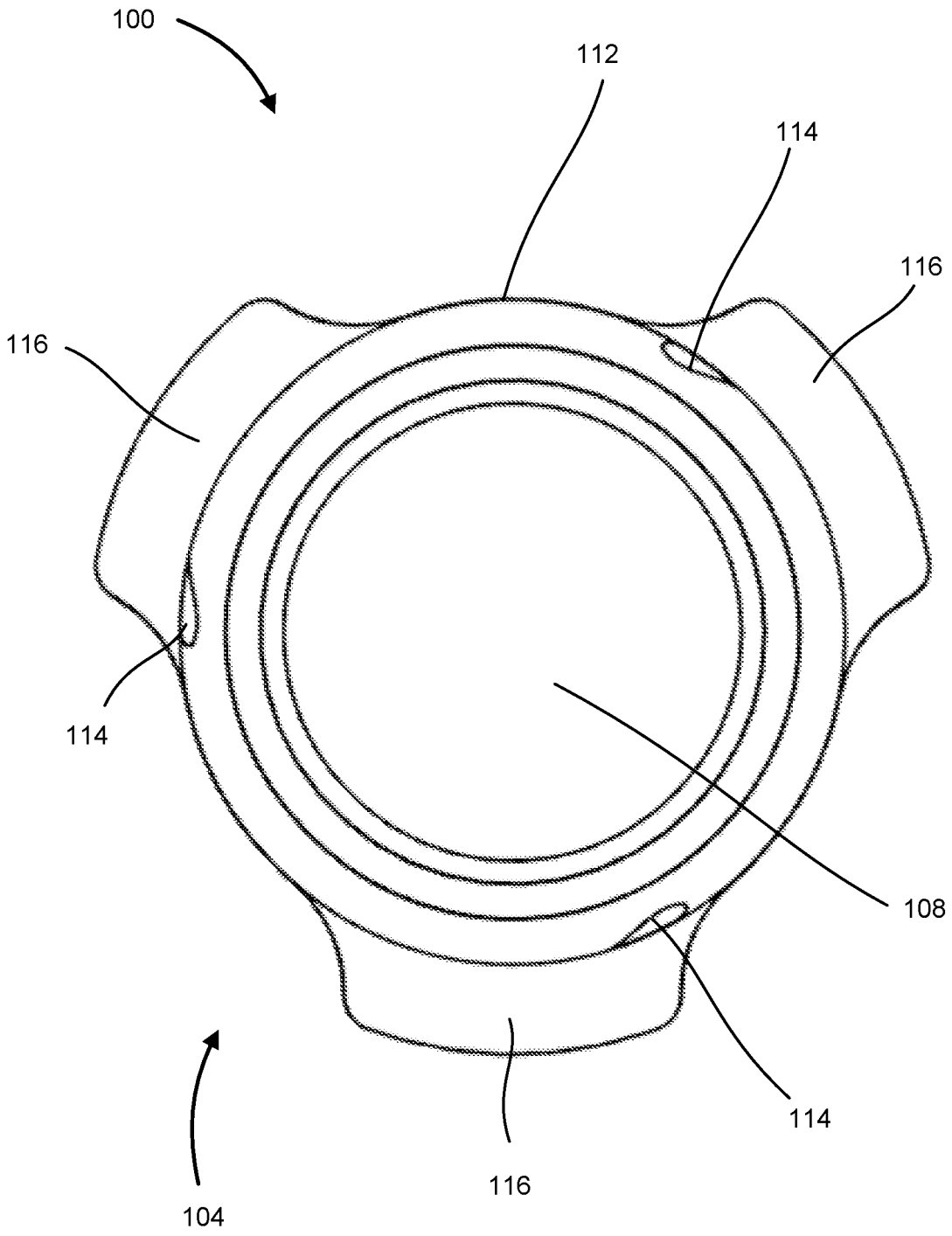
FIG. 3 is an end view of a second end of the suppressor mount adapter or device of FIG. 1.
Figure 4:
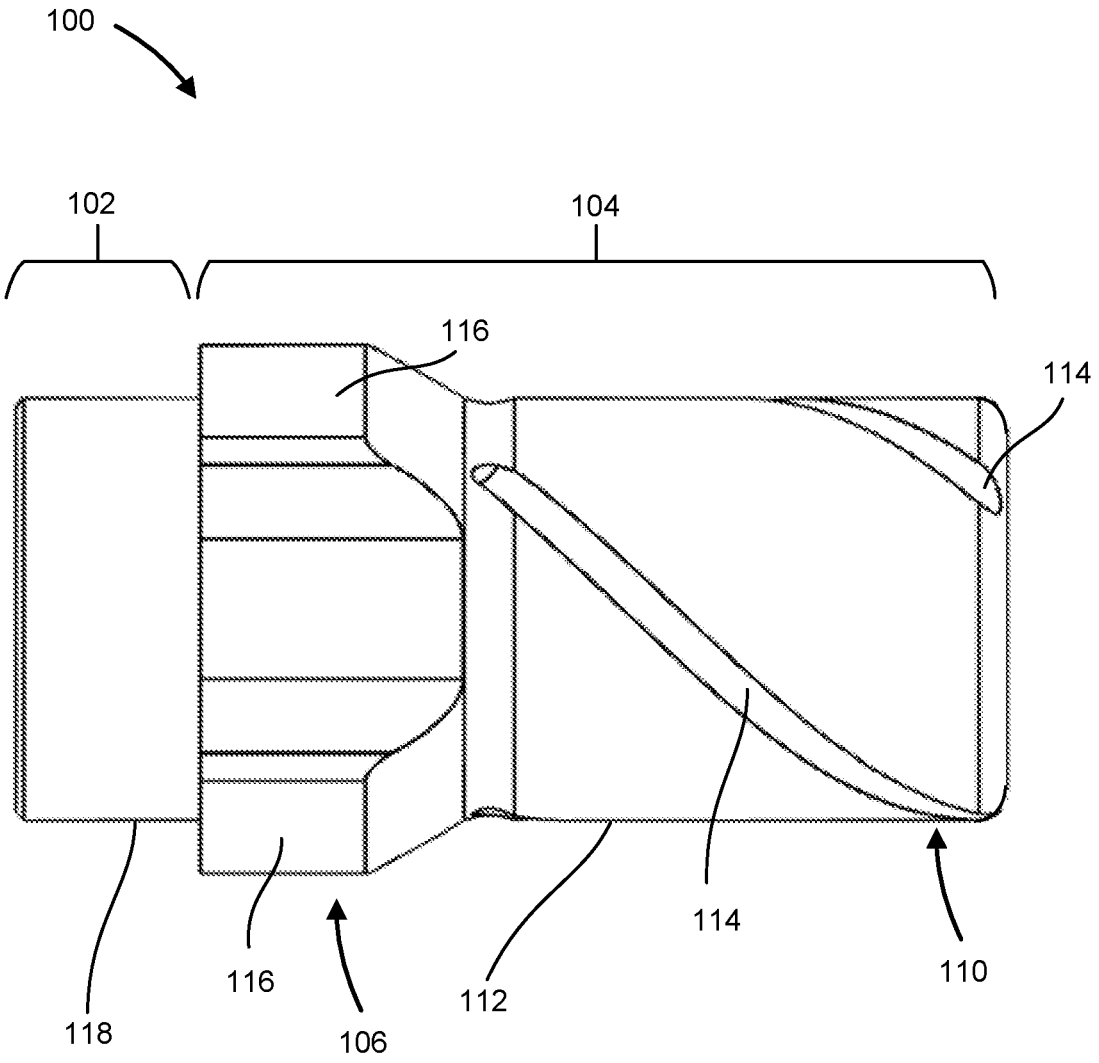
FIG. 4 is a first side view of the suppressor mount adapter or device of FIG. 1.
Figure 5:
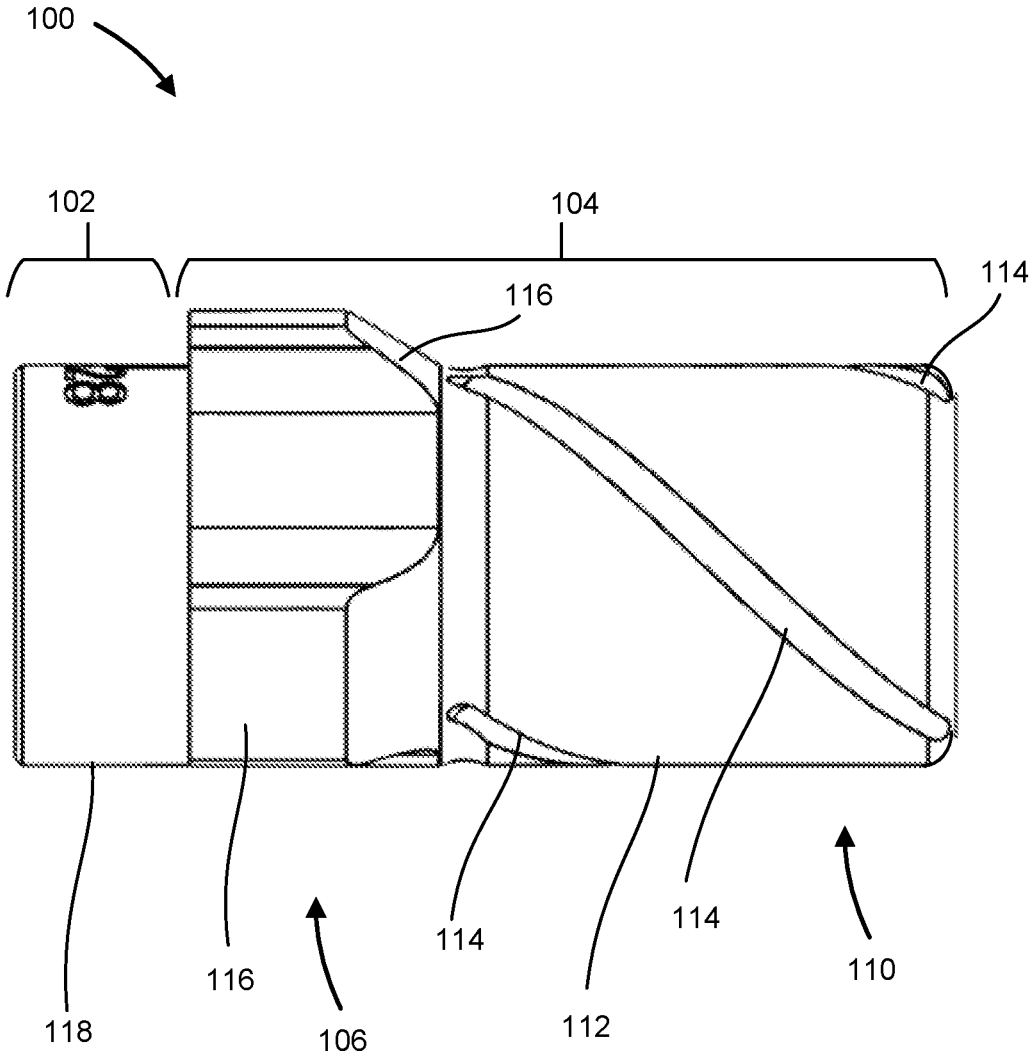
FIG. 5 is a second side view of the suppressor mount adapter or device of FIG. 1.
Figure 6:
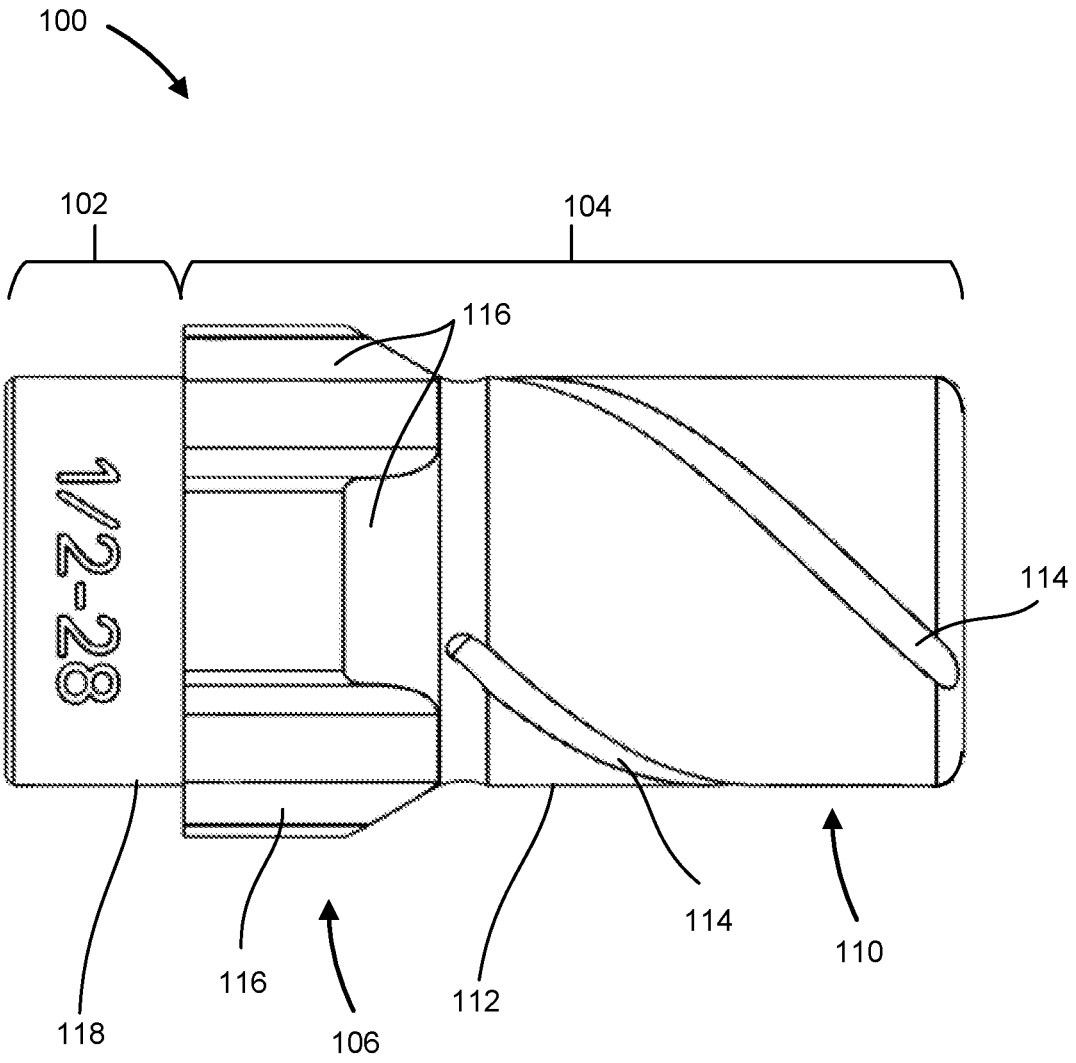
FIG. 6 is a third side view of the suppressor mount adapter or device of FIG. 1.

As a general guideline, the reaming feature can follow a pitch of 10° to 70° relative to the bore axis A, and most often from about 15° to 50°. Further, in some examples, the reaming feature can substantially circumscribe, or completely circumscribe the outer surface. Such coverage can be achieved as a single reaming feature which passes through at least 360° around a circumference of the device, or can be achieved using multiple reaming features as illustrated in FIG. 1-3 with three reaming segment features. In such cases, each reaming segment can span 120°, for example, although other geometries can be designed consistent with this guidance. Depending on the type of mounting interface, the suppressor may rotate from about 5° to several full rotations (i.e. threaded interfaces). As such, a desired span of the reaming features can vary from a few degrees to a full 360° along the outer surface in order to provide removal of fouling from an entire interface between a suppressor and a suppressor mount (e.g., the inner surface 202 of the suppressor 200 and/or the outer surface 112 of the suppressor mount device 100). Regardless, such features can thus provide contact with substantially an entire radial circumference of an inner surface of a suppressor interface.

While the figures illustrate three channels 114, it will be appreciated that any number of channels 114 can be formed in the outer surface 112 without departing from the scope of this disclosure. In other words, the number of channels 114 of the reaming feature 110 is not intended to be limited by this disclosure in any way. For example, the reaming feature 110 can include one or more channels that are formed in helical paths around an entire circumference of the outer surface 112. Additionally or alternatively, the reaming feature 110 can have a plurality of channels formed in partial helical paths around part of the circumference of the outer surface 112.

As illustrated in FIG. 1, the suppressor coupling feature 106 of the suppressor mount device 100 can include one or more lugs 116 that protrude outward from an outer circumferential surface 118 of the suppressor mount device 100. The lugs 116 can be adapted to receive and retain the firearm suppressor. The suppressor coupling feature 106 shown in the figures is specifically known in the art and referred to as a "3-lug" coupling configuration, in which three lugs 116 are used to receive and retain a firearm suppressor. It will be appreciated that, although three lugs 116 are specifically illustrated in FIG. 1, any number of lugs, from one or more, can be used and configured to receive and retain the firearm suppressor. In other words, the number of lugs protruding from the suppressor mount device 100 is not intended to be limited by this disclosure in any way.

FIGS. 2 and 3 illustrate an exemplary arrangement of the lugs 116 around the outer circumferential surface 118 of the suppressor mount device 100. FIG. 2 illustrates the suppressor mount device 100 viewed from the second end 104 side and FIG. 3 illustrates the suppressor mount device 100 viewed from the first end 102 side. As illustrated in both FIGS. 2 and 3, the lugs 116 can be radially spaced about the outer circumferential surface 118 of the suppressor mount device 100. The lugs 116 can be radially spaced at equal distances from each other around the outer circumferential surface 118. However, it will be appreciated that the lugs 116 can be spaced in any configuration without any intended limitation by the disclosure. Similarly, the channels 114 of the reaming feature 110 can be radially spaced at equal distances from each other around the outer surface 112. It will be appreciated that the channels 114 can be spaced in any configuration without any intended limitation by the disclosure. Additional views are included in FIGS. 4, 5, and 6 to illustrate various sides of the suppressor mount device 100 and to show exemplary configurations of the lugs 116 and channels 114 around the outer circumference of the suppressor mount device 100.

Figure 7A:
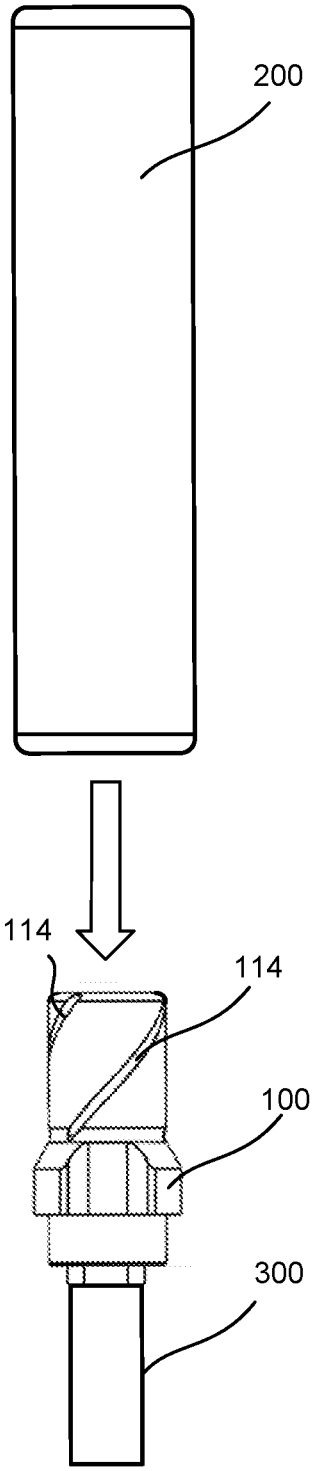
FIG. 7*a* is side view of a firearm suppressor and an exemplary suppressor mount adapter/device on the barrel of a firearm in accordance with an example of the present technology.
Figure 7B:
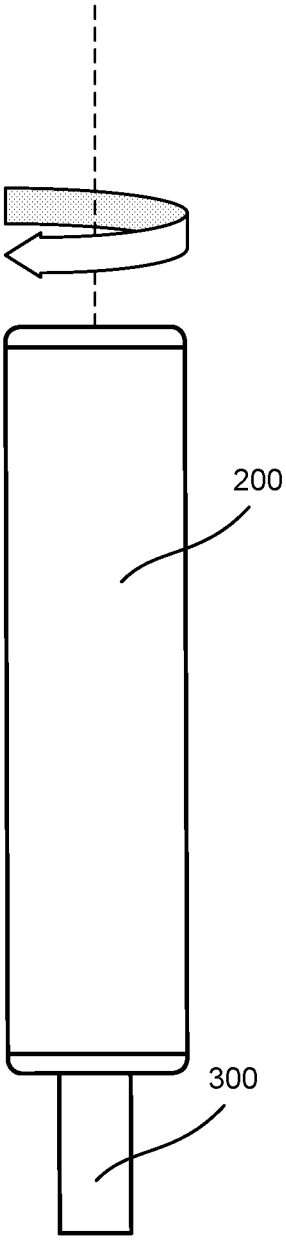
FIG. 7*b* is side view of the firearm suppressor of FIG. 7*a* being attached to the exemplary suppressor mount adapter/device in accordance with an example of the present technology.
Figure 7C:
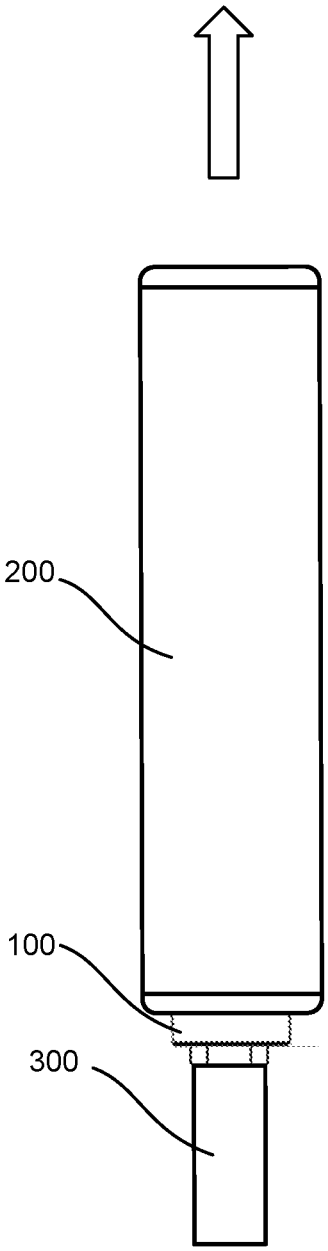
FIG. 7*c* is side view of the firearm suppressor of FIG. 7*a* being engaged with the exemplary suppressor mount adapter/device in accordance with an example of the present technology.

The operation of the reaming feature 110 will now be described with respect to FIGS. 7*a*-7*c* and 8. The installation of a firearm suppressor 200 on the suppressor mount device 100 is illustrated in FIGS. 7*a*-7*c*. As illustrated in FIG. 7*a*, the suppressor mount device 100 can be mounted on a barrel 300 of a firearm. It is to be appreciated that the suppressor mount device 100 can be an adapter configured to removably couple to the barrel 300 to facilitate adapting any firearm with any barrel to receive a suppressor. It will be further appreciated that the suppressor mount device 100 can instead be integrally formed with the barrel 300 or can be fixedly coupled to the barrel 300 such that the suppressor mount device 100 is an integral part of the barrel 300 and is not removable or separable from the barrel except by using destructive operations.

Figure 8:
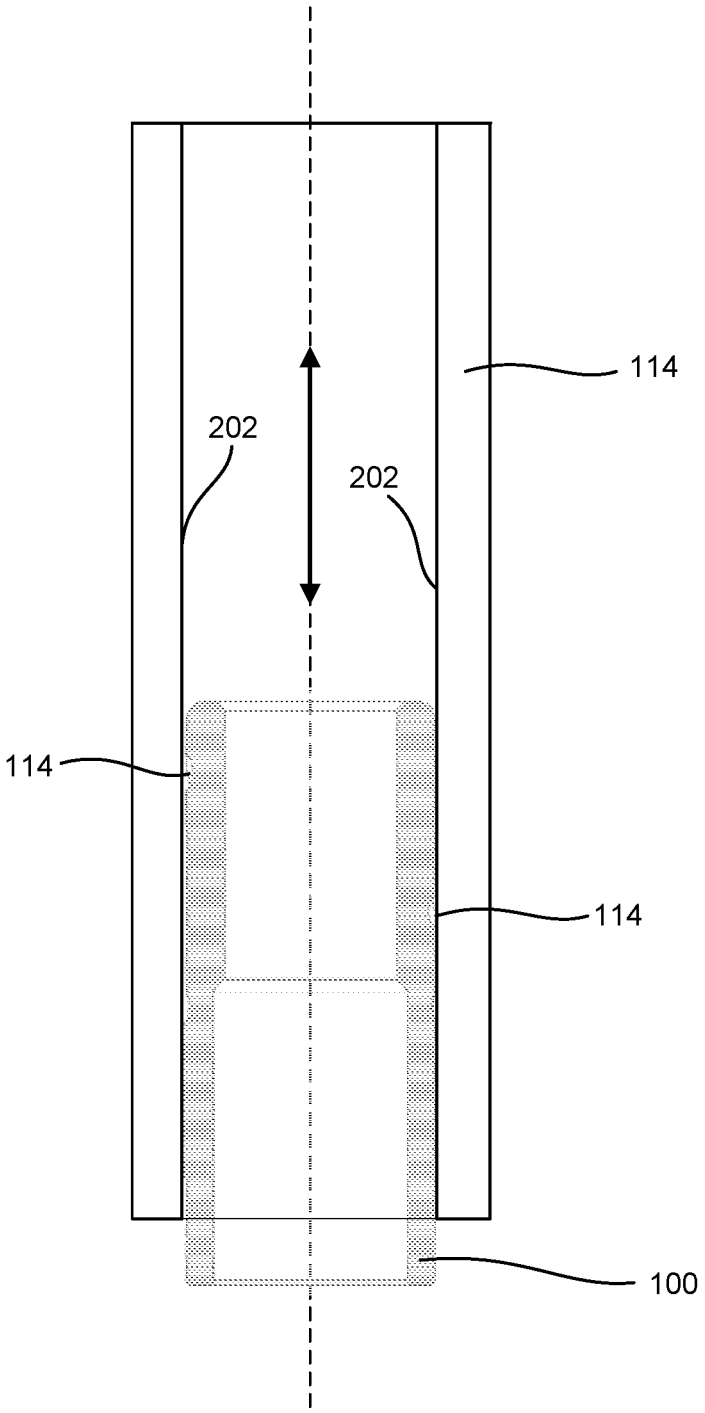
FIG. 8 illustrates a cross-sectional side view of an exemplary suppressor mount device inside of an exemplary firearm suppressor in accordance with an example of the present technology.

In the operation shown in FIG. 7*a*, the firearm suppressor 200 is lowered onto the suppressor mount device 100 such that the suppressor mount device 100 is inserted into the firearm suppressor 200. FIG. 7*b* illustrates the suppressor 200 with the suppressor mount device 100 disposed inside. In this state, the reaming feature 110 (e g, channels 114) engage with an inner surface 202 of the suppressor 200. FIG. 8 illustrates a cross-section internal view of the suppressor mount device 100 inside the firearm suppressor 200 (e.g., the step illustrated in FIG. 7*a*). As shown in FIG. 8, the reaming feature 110 (e.g., channels 114) is in engagement with the inner surface 202 of the suppressor 200. With the suppressor mount device 100 within the suppressor 200, the suppressor 200 is slid over the top of the lugs 116. As will be appreciated by those of ordinary skill in the art, a suppressor 200 will commonly include features corresponding to the lugs 116 on the suppressor mount. To engage the suppressor 200 with the suppressor mount device 100, the suppressor 200 is rotated with the suppressor mount disposed therein in order to align the lugs 116 with corresponding features of the suppressor 200. Afterwards, as shown in FIG. 7*c*, the suppressor 200 can be moved upward (e.g., by hand, by spring biasing, or by any other suitable operation) to engage the suppressor 200 with the lugs 116.

The process of removing the suppressor 200 from the suppressor mount device 100 can be the same but in reverse. For example, the suppressor 200 can be pushed down to disengage the suppressor 200 from the lugs 116, the suppressor 200 can be turned on the suppressor mount device 100 to align the suppressor 200 to be removed from the suppressor mount device 100, and the suppressor 200 can be disengaged from the suppressor mount device 100.

According to the above-described process for engaging and disengaging the suppressor 200 from the suppressor mount device 100, during both attachment and removal of the suppressor 200 from the suppressor mount device 100, the suppressor mount device rotates relative to the suppressor 200 causing the reaming feature (e.g., channels 114) to cut, scrape, or otherwise clean copper, lead, carbon, grease, dirt, and/or other fouling from between the inner surface 202 of the suppressor 200 and the outer surface 112 of the suppressor mount device 100 (e.g., at the mounting interface between the suppressor 200 and the suppressor mount device 100). The shape of the channels (i.e., being at least partially oriented non-parallel and non-perpendicular to the bore axis A of the suppressor mount device 100) causes the fouling to be scraped and moved in directions both along the bore axis A and radially around the bore axis A to effectively and efficiently dislodge and remove fouling from the interface between the inner surface 202 of the suppressor 200 and the outer surface 112 of the suppressor mount device 100. This removal is accomplished both during attachment and detachment of the suppressor 200, thereby ensuring that the suppressor 200 is frequently maintained and cleaned of fouling. This can ensure a longer life, better operation, reduction of binding during removal/attachment, and better muffling of sounds due to the fact that fouling is less likely to build up and interfere with the operation of the suppressor 200 and/or suppressor mount device 100.

Figure 9A:
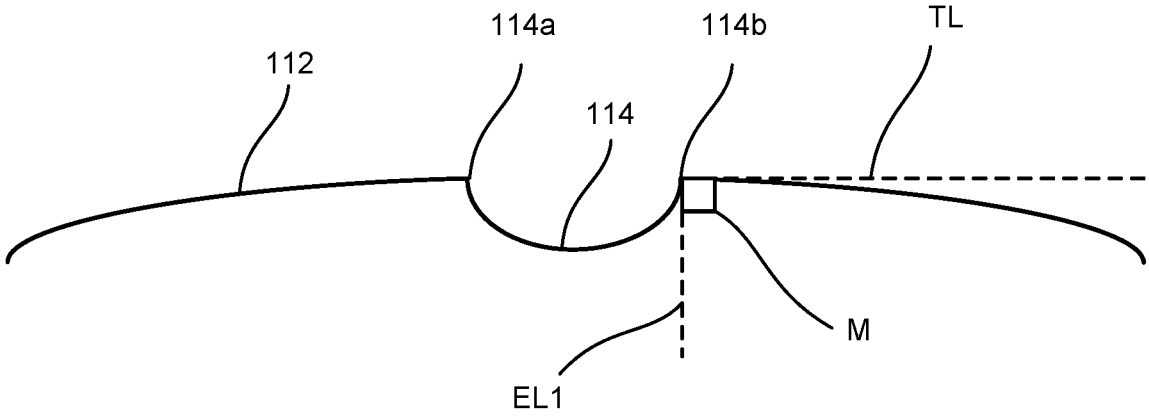
FIG. 9*a* illustrates a cross-sectional side view of an exemplary channel formed as a reaming feature of a suppressor mount device in accordance with an example of the present technology.

To further facilitate removal of fouling from between the inner surface 202 of the suppressor 200 and the outer surface 112 of the suppressor mount device 100, one or more edges of the channel can be sharpened to better engage with fouling at the interface of the firearm suppressor 200 and the suppressor mount device 100 during attachment and detachment of the firearm suppressor 200 from the suppressor mount device 100. For example, as shown in FIG. 9*a*, one or more edges (e.g., edges 114*a* and 114*b*) can be sharpened to a desired angle. As shown in FIG. 9*a*, the edges 114*a* and 114*b* of channel 114 can be angled such that the edges form a 90 degree angle M with a tangent line TL that is tangential to the surface 112. The direction of the edge 114*b* relative to the tangent line TL is shown by edge line ELL As shown, the edge line EU of edge 114*b* forms a 90 degree angle M with the tangent line TL.

Figure 9B:
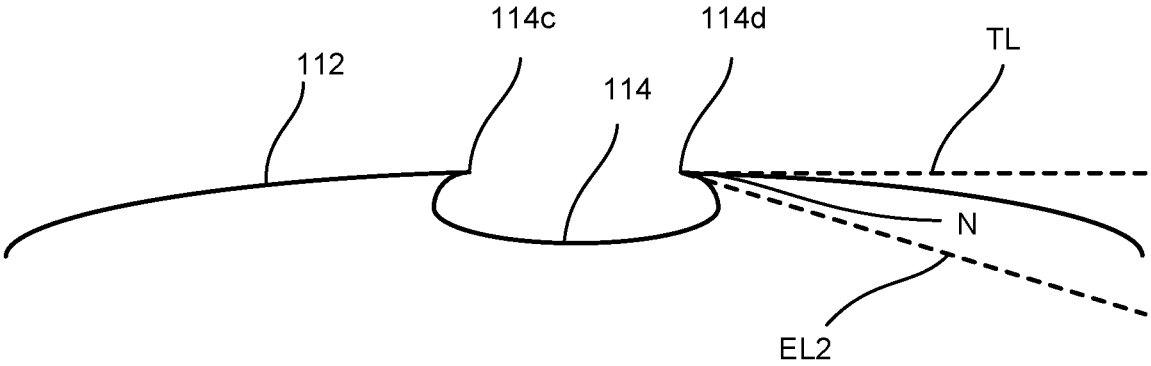
FIG. 9*b* illustrates a cross-sectional side view of an exemplary channel formed as a reaming feature of a suppressor mount device in accordance with an example of the present technology.

The edge can be sharpened further to a sharper angle N. As shown in FIG. 9*b*, one or more edges (e.g., edges 114*c* and 114*d*) can be angled such that the edges form an angle N that is less than 90 degrees with the tangent line TL. The direction of the edge 114*d* relative to the tangent line TL is shown by edge line EL2. As shown, the edge line EL2 of edge 114*d* forms an angle N of less than 90 degrees with the tangent line TL. Accordingly, the edges 114 can be sharpened to an angle of 90 degrees or less. It will be appreciated that all edges of all channels 114 formed on a suppressor mount device 100 can be sharpened to a desirable angle. However, in alternative examples, fewer than all edges or only one edge of each channel 114 may be sharpened. Furthermore, not every channel 114 needs to include sharpened edge(s). One or more channels 114 can be configured to have unsharpened edges while only one channel 114 includes a single sharpened edge. Accordingly, the combinations and configuration of sharpened edges in a plurality of channels 114 is not intended to be limited by this disclosure to only one particular configuration.

Figure 10A:
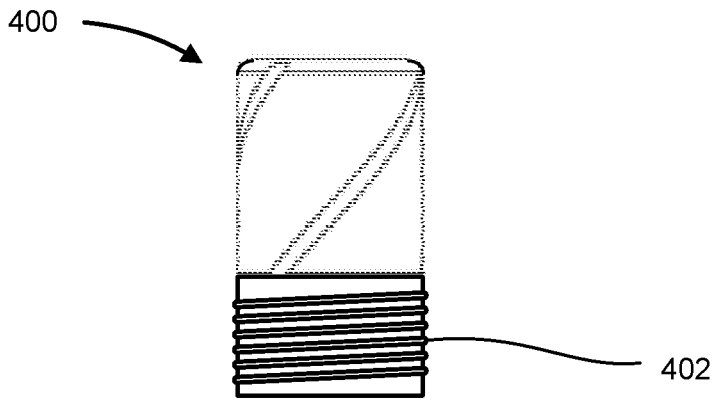
FIG. 10*a* illustrates a side view of a suppressor mount adapter or device in accordance with examples of the present technology.

It will be appreciated by those skilled in the art that the 3-lug configuration is not the only option for mounting a suppressor 200 to the barrel of a firearm or to a suppressor mount adapter. Several different configurations exist for mounting a suppressor 200 to a firearm. The reaming feature of the present disclosure can be incorporated into any of the options existing for mounting a suppressor to a firearm. For example, the suppressor coupling feature 106 can include, instead of lugs, a threaded feature formed on an outer circumferential surface of the suppressor mount device 100 that corresponds to a complementary threaded feature formed in the firearm suppressor 200 and that is adapted to receive and retain the firearm suppressor 200. FIG. 10*a* illustrates a suppressor mount device 400 comprising a threaded feature 402 replacing the lugs of the 3-lug configuration.

The threaded feature 402 can be threaded in a direction such that the direction of rifling rotation imparted on the projectile from the barrel of the firearm tightens the firearm suppressor onto the suppressor mount device 400. For example, if the firearm is configured to impart a clockwise rotation on a projectile, then the suppressor 200 can be threaded such that the suppressor is tightened onto the threaded feature 402 of the suppressor mount device 400 by the clockwise rotation of the projectile. Conversely, if the firearm is configured to impart a counterclockwise rotation on a projectile, then the suppressor 200 can be threaded such that the suppressor is tightened onto the threaded feature of the suppressor mount device by the counterclockwise rotation of the projectile.

Figure 10B:
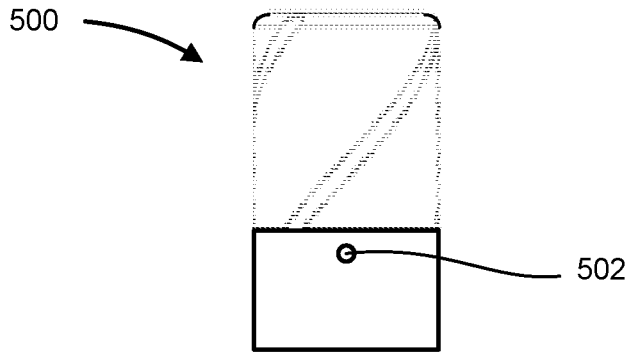
FIG. 10*b* illustrates a side view of a suppressor mount adapter or device in accordance with examples of the present technology.
Figure 10C:
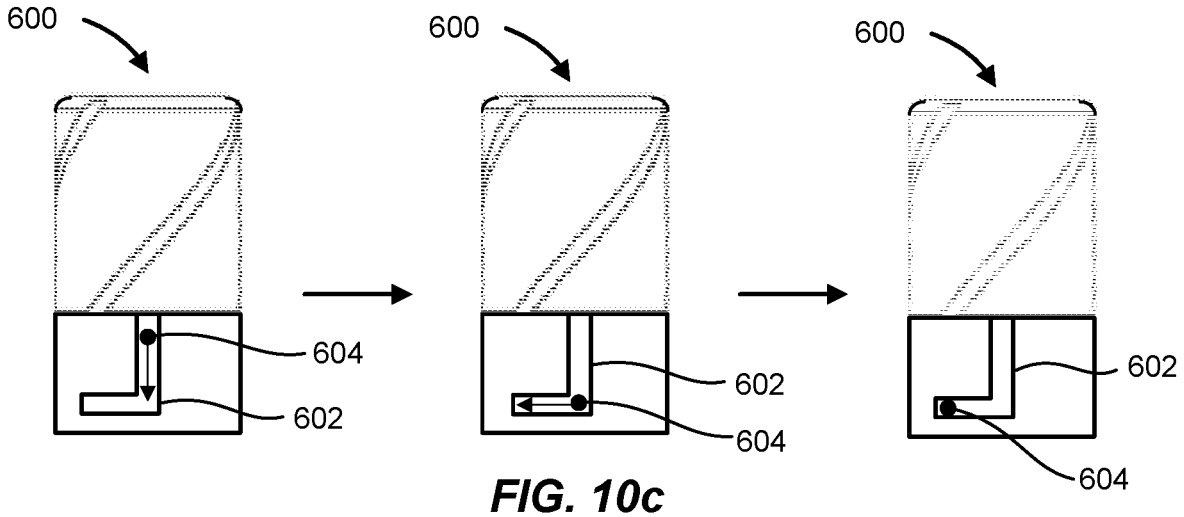
FIG. 10*c* illustrates a side view of a suppressor mount adapter or device in accordance with examples of the present technology and a process of attaching the suppressor mount adapter to a firearm suppressor.

In alternative examples, the suppressor coupling feature can include a protrusion formed on the outer surface of the suppressor mount device and adapted to engage with a notch formed in the firearm suppressor. For example, FIG. 10*b* illustrates a suppressor mount device 500 including a protrusion 502. The protrusion can be configured to engage with a corresponding notch formed on a firearm suppressor adapted to be received and retained on the suppressor mount device 500. Alternatively, the suppressor coupling feature can include a notch formed on an outer surface of the suppressor mount device and adapted to engage with a protrusion formed on the firearm suppressor. For example, FIG. 10*c* illustrates an exemplary suppressor mount device 600 having a notch 602 formed therein and configured to receive a corresponding protrusion 604 disposed on an inner surface of a firearm suppressor adapted to be received and retained on the suppressor mount device 600. FIG. 10*c* illustrates a sequence in which the protrusion 604 of a firearm suppressor is inserted into the notch 602 and locked into place within the notch 602 by rotation of the firearm suppressor relative to the suppressor mount device 600. In short, it will be appreciated that any configuration of attaching a suppressor to a suppressor mount is contemplated within the teachings of this disclosure, with no specific limitation intended.

Figure 11:
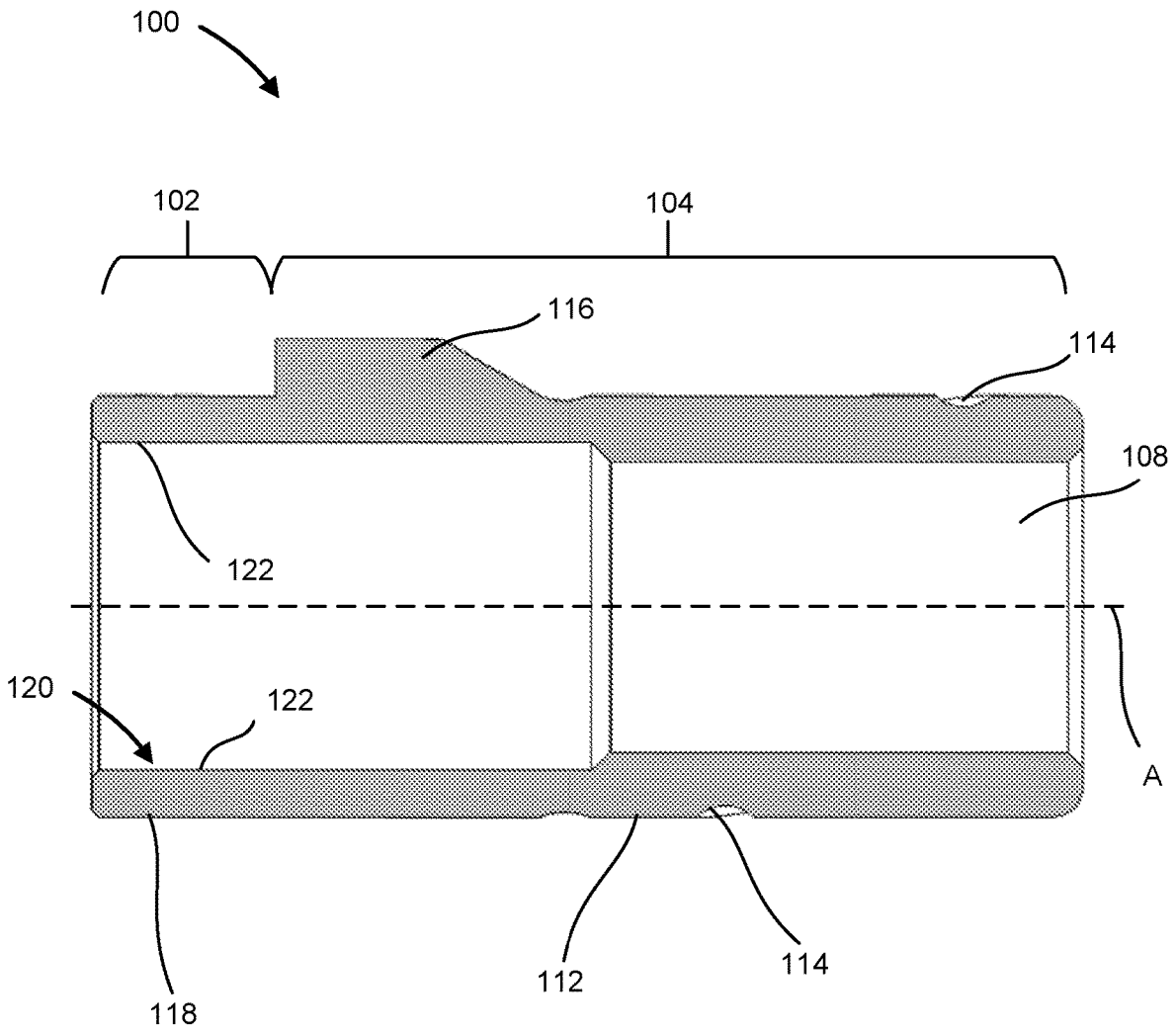
FIG. 11 illustrates a cross-sectional side view of the suppressor mount device of FIG. 1.

The method and/or mechanism for attaching the suppressor mount device 100 to the barrel of a firearm is not particularly limited by this disclosure. Any method or mechanism for coupling the suppressor mount device 100 to the barrel of a firearm is contemplated by this disclosure. For example, a barrel coupling feature 120 of the suppressor mount device 100 can include a threaded barrel coupling feature 120 formed on an inner surface 122 of the first end 102 adapted to mate with a corresponding threaded barrel coupling feature 402 formed on the barrel 300 of the firearm. The surface 122 of the first end 102 that can be threaded is illustrated in FIG. 11, which shows a cross-sectional view of the internal configuration of the suppressor mount device 100. Although threads are not specifically illustrated on the surface 122, it will be understood by those of ordinary skill in the art that threads can be formed on such a surface 122.

Figure 12A:
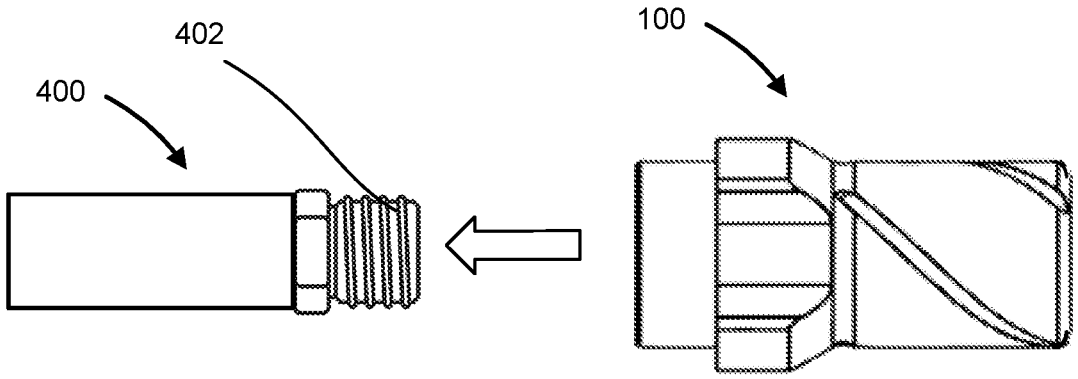
FIGS. 12*a* and 12*b* illustrate a side view of the suppressor mount device of FIG. 1 being attached to the barrel of a firearm.
Figure 12B:
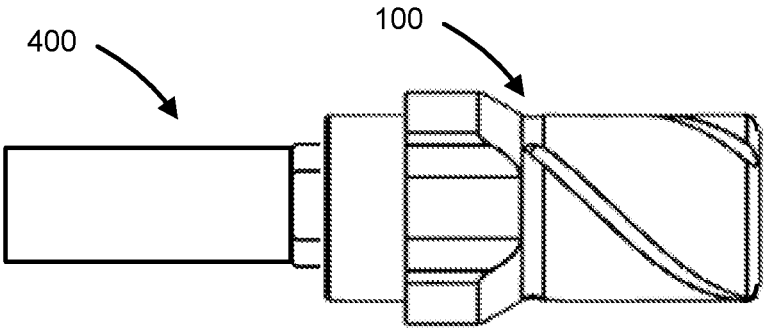

FIG. 12*a* illustrates an exemplary configuration of the suppressor mount device 100 being threaded onto the threaded barrel coupling feature 402 formed on the barrel 400 of the firearm. FIG. 12*b* illustrates the suppressor mount device 100 coupled to the threaded barrel coupling feature 402 formed on the barrel 400.

The threaded barrel coupling feature 120 can be threaded in a direction on the first end 102 such that the direction of rifling rotation imparted on the projectile from the barrel 400 of the firearm tightens the suppressor mount device 100 on to the barrel 400 of the firearm. For example, if the firearm is configured to impart a clockwise rotation on a projectile, then the suppressor mount device 100 can be threaded such that the suppressor mount device 100 is tightened onto the complementary threaded barrel coupling feature 402 of the barrel 400 by the clockwise rotation of the projectile. Conversely, if the firearm is configured to impart a counterclockwise rotation on a projectile, then the suppressor mount device 100 can be threaded such that the suppressor mount device 100 is tightened onto the complementary threaded barrel coupling feature 402 of the suppressor mount device 100 by the counterclockwise rotation of the projectile. In short, it will be appreciated that any configuration of attaching a suppressor mount device to a barrel of a firearm is contemplated within the teachings of this disclosure, with no specific limitation intended.

It will further be appreciated that additional functions can be accomplished by the suppressor mount devices described herein. The suppressor mount devices can serve plural functions and can further serve as a muzzle brake, a mount for additional firearm components such as a sight, a mount for a rest device to support the gun while not in use, or any functions that may be known or used in the art.

Although the devices described are exemplified in terms of firearms, other applications can also benefit from these configurations. For example, any applications in which fouling, residue, dirt, and/or debris is to be removed at an interface between an outer tubular structure and an inner tubular structure, the reaming feature as described herein can be utilized.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A suppressor mount device comprising:

a first end having a barrel coupling feature adapted to couple the suppressor mount device to a barrel of a firearm;

a second end oriented opposite the first end along a bore axis and comprising a suppressor coupling feature adapted to receive and retain a firearm suppressor;

a bore forming a void along the bore axis within the suppressor mount device, the bore adapted to allow passage of a projectile along the bore axis from the first end to the second end; and a reaming feature formed on an outer surface of the second end adapted to engage an inner surface of the firearm suppressor, wherein the reaming feature includes a channel which is at least partially oriented non-parallel and non-perpendicular to the bore axis of the suppressor mount device.

2. The suppressor mount device of claim 1, wherein the suppressor coupling feature comprises one or more lugs that protrude outward from an outer circumferential surface of the suppressor mount device and are adapted to receive and retain the firearm suppressor.

3. The suppressor mount device of claim 1, wherein the suppressor coupling feature comprises three lugs that protrude outward from an outer circumferential surface of the suppressor mount device and are adapted to receive and retain the firearm suppressor.

4. The suppressor mount device of claim 3, wherein the three lugs are radially spaced at substantially equal distances from each other around the outer circumferential surface.

5. The suppressor mount device of claim 1, wherein the suppressor coupling feature comprises a threaded feature formed on an outer circumferential surface of the suppressor mount device that corresponds to a complementary threaded feature formed in the firearm suppressor and is adapted to receive and retain the firearm suppressor.

6. The suppressor mount device of claim 5, wherein the threaded feature is threaded in a direction such that the direction of rifling rotation imparted on the projectile from the barrel of the firearm tightens the firearm suppressor onto the suppressor mount device.

7. The suppressor mount device of claim 1, wherein the suppressor coupling feature comprises a notch adapted to engage with a protrusion of the firearm suppressor.

8. The suppressor mount device of claim 1, wherein the suppressor coupling feature comprises a protrusion adapted to engage with a notch of the firearm suppressor.

9. The suppressor mount device of claim 1, wherein the barrel coupling feature comprises a threaded ban-el coupling feature formed on an outer surface or an inner surface of the first end adapted to mate with a corresponding threaded barrel coupling feature formed on the barrel of the firearm.

10. The suppressor mount device of claim 9, wherein the threaded barrel coupling feature is threaded in a direction on the first end such that the direction of rifling rotation imparted on the projectile from the barrel of the firearm tightens the suppressor mount device on to the barrel of the firearm.

11. The suppressor mount device of claim 1, wherein the channel is formed in an at least partially helical path around the outer surface of the second end.

12. The suppressor mount device of claim 11, wherein one or more edges of the channel comprises a sharpened edge to further facilitate removal of fouling from the inner surface of the firearm suppressor during attachment and detachment of the firearm suppressor from the suppressor mount device.

13. The suppressor mount device of claim 12, wherein the sharpened edge has an angle relative to the outer surface of the second end of 90° or less.

14. The suppressor mount device of claim 1, wherein the reaming feature comprises a plurality of the channels, each formed in an at least partially helical path around the outer surface of the second end.

15. The suppressor mount device of claim 14, wherein one or more edges of one or more of the plurality of the channels comprises a sharpened edge to further facilitate removal of fouling from the inner surface of the firearm suppressor during attachment and detachment of the firearm suppressor from the suppressor mount device.

16. The suppressor mount device of claim 1, wherein the suppressor mount device is a muzzle brake.

17. A 3-lug adapter comprising:

a first end having a barrel coupling feature adapted to couple the 3-lug adapter to a barrel of a firearm;

a second end oriented opposite the first end along a bore axis and comprising three lugs that are radially spaced to protrude outward from an outer circumferential surface of the 3-lug adapter and are adapted to receive and retain a firearm suppressor;

a bore forming a void along the bore axis within the 3-lug adapter, the bore adapted to allow passage of a projectile along the bore axis from the first end to the second end; and a reaming feature formed on the outer circumferential surface of the second end and adapted to engage an inner surface of the firearm suppressor to clean fouling from the inner surface of the firearm suppressor during attachment and detachment of the firearm suppressor from the 3-lug adapter, wherein the reaming feature includes a plurality of channels each formed in an at least partially helical path about the outer circumferential surface of the second end.

18. The 3-lug adapter of claim 17, wherein the barrel coupling feature comprises a threaded feature formed on an outer surface or an inner surface of the first end adapted to mate with a corresponding threaded feature formed on the barrel of the firearm; and wherein the threaded feature is threaded in a direction on the first end such that the direction of rifling rotation imparted on the projectile from the barrel of the firearm tightens the 3-lug adapter on to the barrel of the firearm.

19. The 3-lug adapter of claim 17, wherein one or more edges of one or more of the plurality of channels comprises a sharpened edge to further facilitate removal of fouling from the inner surface of the firearm suppressor during attachment and detachment of the firearm suppressor from the 3-lug adapter.

20. The 3-lug adapter of claim 17, wherein the 3-lug adapter is a muzzle brake.

* * * * *